US006106103A

United States Patent [19]

Ahn

[11] Patent Number: 6,106,103

[45] **Date of Patent: *Aug. 22, 2000**

[54] INK-JET SPRAYING DEVICE AND METHOD USING ULTRASONIC WAVES

[75] Inventor: Byung-sun Ahn, Kyungki-do, Rep. of Korea

[73] Assignee: SamSung Electronics Co., Ltd., Suwon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 09/005,583

[22] Filed: Jan. 12, 1998

[30] Foreign Application Priority Data

Jan. 11, 1997 [KR] Rep. of Korea ..... 97-00577

[51] Int. Cl.[7] ..... B41J 2/06; B41J 2/045; G03G 15/09

[52] U.S. Cl. ..... 347/55; 347/70; 399/260

[58] Field of Search ..... 347/55, 84, 103, 347/68, 70, 71, 154, 123, 111, 139, 127, 128, 17, 141, 120, 151; 399/271, 290, 292, 293, 294, 295, 260, 261

[56] References Cited

U.S. PATENT DOCUMENTS

| | | | |
|---|---|---|---|
| 4,166,277 | 8/1979 | Cielo et al. | 347/55 |
| 4,238,807 | 12/1980 | Bovio et al. | 347/55 |
| 5,036,341 | 7/1991 | Larsson | 347/55 |
| 5,357,274 | 10/1994 | Kitamura | 347/55 |

*Primary Examiner*—John Barlow
*Assistant Examiner*—Raquel Yvette Gordon
*Attorney, Agent, or Firm*—Robert E. Bushnell

[57] ABSTRACT

An ink-jet spraying device includes an ink chamber for holding ink corresponding to an opening in a nozzle plate; an ultrasonic vibration plate which vibrates in order to separate pigment particles in the ink; a mesh grid for electrically charging the separated pigment particles, with a voltage applied; and an electric field formation circuit for spraying the electrically charged pigment particles through the nozzle openings in accordance with a print command. The separated pigment particles acquire an electric polarity while passing through the mesh grid, since the voltage applied to the mesh grid is greater or equal to that of the formed electric field. The electric field formation circuit includes: a common electrode installed under the ink chamber; and individual electrodes disposed above the ink chamber.

16 Claims, 8 Drawing Sheets

INK-JET SPRAYING DEVICE AND METHOD USING ULTRASONIC WAVES

CLAIM OF PRIORITY

This application makes reference to, incorporates the same herein, and claims all benefits accruing under 35 U.S.C. §119 from my application entitled Spraying Device and Method for Ink-jet Printer Using Ultrasonic Waves filed with the Korean Industrial Property Office on Jan. 11, 1997 and there duly assigned Ser. No. 97-00577 by that Office.

BACKGROUND OF THE INVENTION

1. Field of the Invention

The present invention relates to an ink-jet printer's spraying device, that is, its cartridge's head, and more particularly, to a spraying device and method for an ink-jet printer, in which pigment particles are separated within ink using ultrasonic waves, electrically charged through a mesh grid, and then ejected using a potential difference of an electric field density selectively formed.

2. Description of the Prior Art

The structure and operational principle of a general inkjet printer will be described below with reference to FIG. 1.

An ink-jet printer has a CPU 10 for receiving a signal from a host computer (not shown) through its printer interface, reading a system program in an EPROM 11 that stores initial values for operating the printer and the overall system, analyzing the stored values, and outputting control signals according to the content of the program; a ROM 12 for storing a control program and several fonts; a RAM 13 for temporarily storing data during system operation; an ASIC circuit 20, which comprises most of the CPU-controlling logic circuitry, for transmitting data from the CPU 10 to the various peripheral components; a head driver 30 for controlling the operation of an ink cartridge 31 according to the control signals of the CPU 10 transmitted from the ASIC circuit 20; a main motor driver 40 for driving a main motor 41 and for preventing the nozzle of the ink cartridge 31 from exposure to air; a carriage return motor driver 50 for controlling the operation of a carriage return motor 51; and a line feed motor driver 60 for controlling the operation of a line feed motor 61 which is a stepping motor for feeding/discharging paper.

In the operation of the above apparatus, a printing signal from the host computer is applied through the printer interface thereof, to drive each of the motors 41, 51 and 61 according to the control signal of the CPU 10 and thus perform printing. Here, the ink cartridge 31 forms dots by spraying fine ink drops through a plurality of openings in its nozzle.

The ink cartridge 31, shown in FIG. 2, comprises a case 1, which forms the external profile of the cartridge, for housing a sponge-filled interior 2 for retaining the ink. Also included in the ink cartridge 31 is a head 3, shown in detail in FIG. 3, which has a filter 32 for removing impurities in the ink; an ink stand pipe chamber 33 for containing the filtered ink; an ink via 34 for supplying ink transmitted through the ink stand pipe chamber 33 to an ink chamber (see FIG. 5) of a chip 35; and a nozzle plate 111 having a plurality of openings, for spraying ink in the ink chamber transmitted from the ink via 34 onto printing media (e.g., a sheet of paper).

As illustrated in FIG. 4, besides the ink via 34, the head 3 includes a plurality of ink channels 37 for supplying ink from the ink via to each opening of the nozzle plate 111; a plurality of nozzles 110 for spraying ink transmitted through the ink channels 37; and a plurality of electrical connections 38 for supplying power to the chip 35.

As illustrated in FIG. 5, the head 3 includes a resistor layer 103 formed on a silicon dioxide ($SiO_2$) layer 102 on a silicon substrate 101 and heated by electrical energy; a pair of electrodes 104 and 104' formed on the resistor layer 103 and thus providing it with electrical energy; a protective layer 106 formed on the pair of electrodes 104 and 104' and on the resistor layer 103, for preventing a heating portion 105 from being etched/damaged by a chemical reaction to the ink an ink chamber 107 for generating bubbles by the heat from the heating portion 105; an ink barrier 109 acting as a wall defining the space for flowing the ink into the ink chamber 107; and a nozzle plate 111 having an opening 110 for spraying the ink pushed out by a volume variation, i.e., the bubbles, in the ink chamber 107.

Here, the nozzle plate 111 and the heating portion 105 oppose each other with a regular spacing. The pair of electrodes 104 and 104' are electrically connected to a terminal (not shown) which is in turn connected to the head controller (FIG. 1), so that the ink is sprayed from each nozzle opening.

The thus-structured conventional ink spraying device operates as follows. The head driver 30 transmits electrical energy to the pair of electrodes 104 and 104' positioned where the desired dots are to be printed, according to the printing control command received through the printer interface from the CPU 10. This power is transmitted for a predetermined time through the selected pair of electrodes 104 and 104' and heats the heating portion 105 by electrical resistance heating (measured in joules) as determined by $P=I^2R$. The heating portion 105 is heated to 500° C.–550° C., and the heat conducts to the protective layer 106 thereon. Here, when the heat is applied to the ink directly wetting the protective layer, the distribution of the bubbles generated by the resulting steam pressure is highest in the center of the heating portion 105 and symmetrically distributed (see FIG. 6). The ink is thereby heated and bubbles are formed, so that the volume of the ink on the heating portion 105 is changed by the generated bubbles. The ink pushed out by the volume variation is expelled through the opening 110 of the nozzle plate 111.

At this time, if the electrical energy supply to the electrodes 104 and 104' is cut off, the heating portion 105 is momentarily cooled and the expanded bubbles are accordingly contracted, thereby returning the ink to its original state.

The ink thus expanded and discharged out through the openings of the nozzle plate is sprayed into the printing media in the form of a drop, forming an image thereon due to surface tension. In doing so, internal pressure is decreased in accordance with the volume of the corresponding bubbles discharged, which causes the ink chamber to refill with ink from the container through the ink via.

However, the above-described conventional ink spraying device has several problems. First, since bubbles are formed in the ink by high-temperature heating and the ink itself exhibits a thermal variation, the lifetime of the head is decreased due to an impact wave from the bubbles. Second, the ink and the protective layer 106 react electrically with each other, resulting in corrosion due to migrating ions from the interface of the heating portion 105 and the electrodes 104 and 104', which thereby further decreases the lifetime of the head. Third, the influence of bubbles being formed in the ink chamber containing ink increases the ink chamber's recharging time. Fourth, the shape of the bubbles affects the advance, circularity and uniformity of the ink drop, which therefore affects printing quality.

Moreover, the ink spraying device as described above, being a thermal type, has certain inherent disadvantages. For example, the employed ink must be capable of operation at very high temperatures and without any resulting changes in its characteristic properties. Further, such ink requires a long drying time after each printing operation due to the volume of liquid (pigment carrier) in the ejected ink. Also, in the construction of the device, the basic configuration of the heating chambers and ink chambers, which make up an array of nozzles, necessitates a difficult alignment and bonding process between two elements of fabrication and consumes valuable wafer space which is limited.

SUMMARY OF THE INVENTION

Therefore, in order to overcome such drawbacks of the prior art, an objective of the present invention is to provide an ink spraying device and-method for an inkjet printer using ultrasonic waves in which pigment particles in the ink are separated therefrom using an ultrasonic vibration technique and then electrically charged by a mesh grid for ejection through a nozzle plate provided with a plurality of electrodes selectively charged with respect to a common electrode.

Another objective of the present invention is to provide a spraying device and method for an ink-jet printer using ultrasonic waves in which printing speed is enhanced by reducing the drying time of ejected ink.

Still another objective of the present invention is to provide a spraying device and method for an ink-jet printer in which the use of special high-temperature ink is unnecessary.

Still yet another objective of the present invention is to provide a spraying device and method for an ink-jet printer in which the structure and manufacturing process are simplified to improve productivity.

To achieve these and other advantages and in accordance with the purpose of the present invention, as embodied and broadly described, there is provided an ink-jet spraying device, comprising: an ink chamber for holding ink corresponding to an opening in a nozzle plate; an ultrasonic vibration plate which vibrates in order to separate pigment particles in the ink; a mesh grid for electrically charging the separated pigment particles, with a voltage applied; and means for forming an electric field, in accordance with a print command, such that the electrically charged pigment particles are ejected through the nozzle openings.

The electric field forming means comprises: a common electrode installed under the ink chamber; and a plurality of individual electrodes disposed above the ink chamber.

According to another aspect of the present invention, there is also provided an ink-jet spraying method, comprising the steps of: separating particles of coloring matter from the carrier of an ink, using ultrasonic waves; electrically charging the separated particles via a mesh grid to which a voltage is applied; forming an electric field in order to exert a migration force to the electrically charged particles in accordance with the direction and intensity of the field; and ejecting the particles through a plurality of openings in a nozzle plate, according to the direction and density of the formed electric field.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENT

Figure 7:
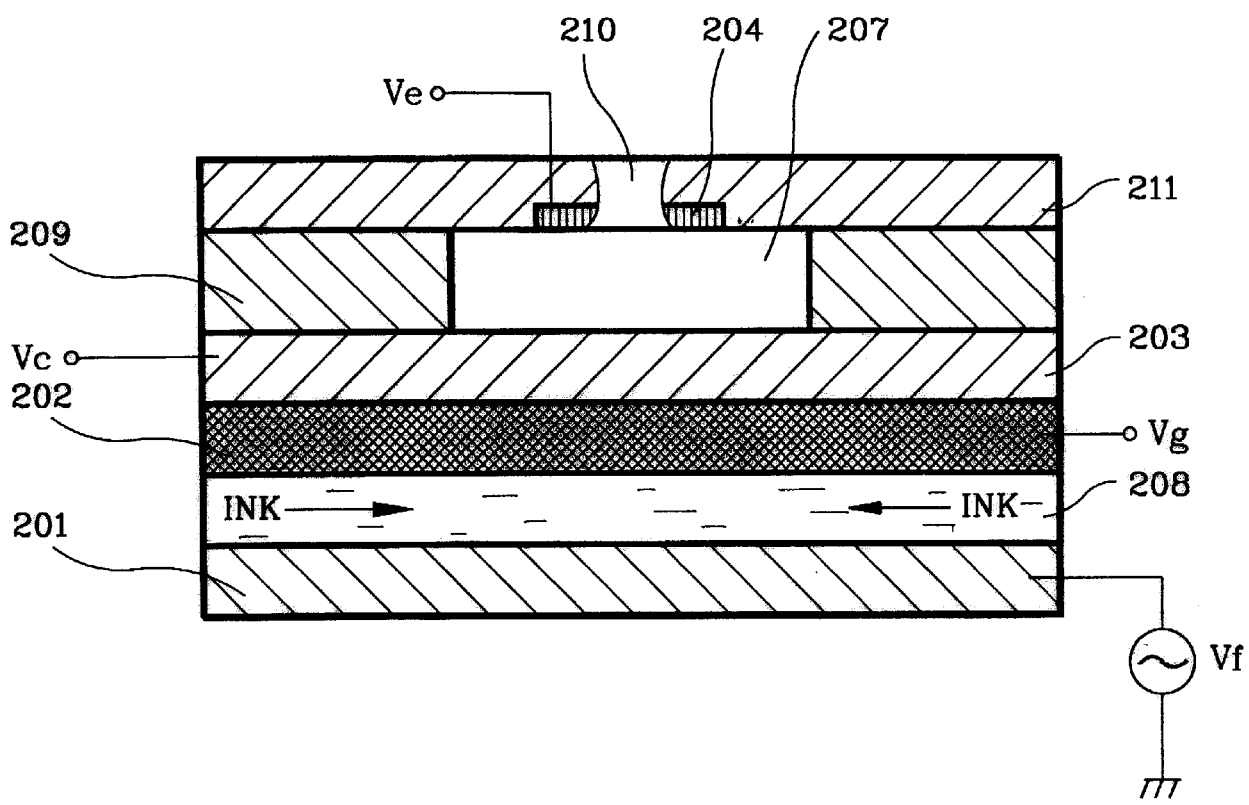
FIG. 7 is an enlarged sectional view of a single unit of an ink-jet spraying device according to the present invention.
Figure 8:
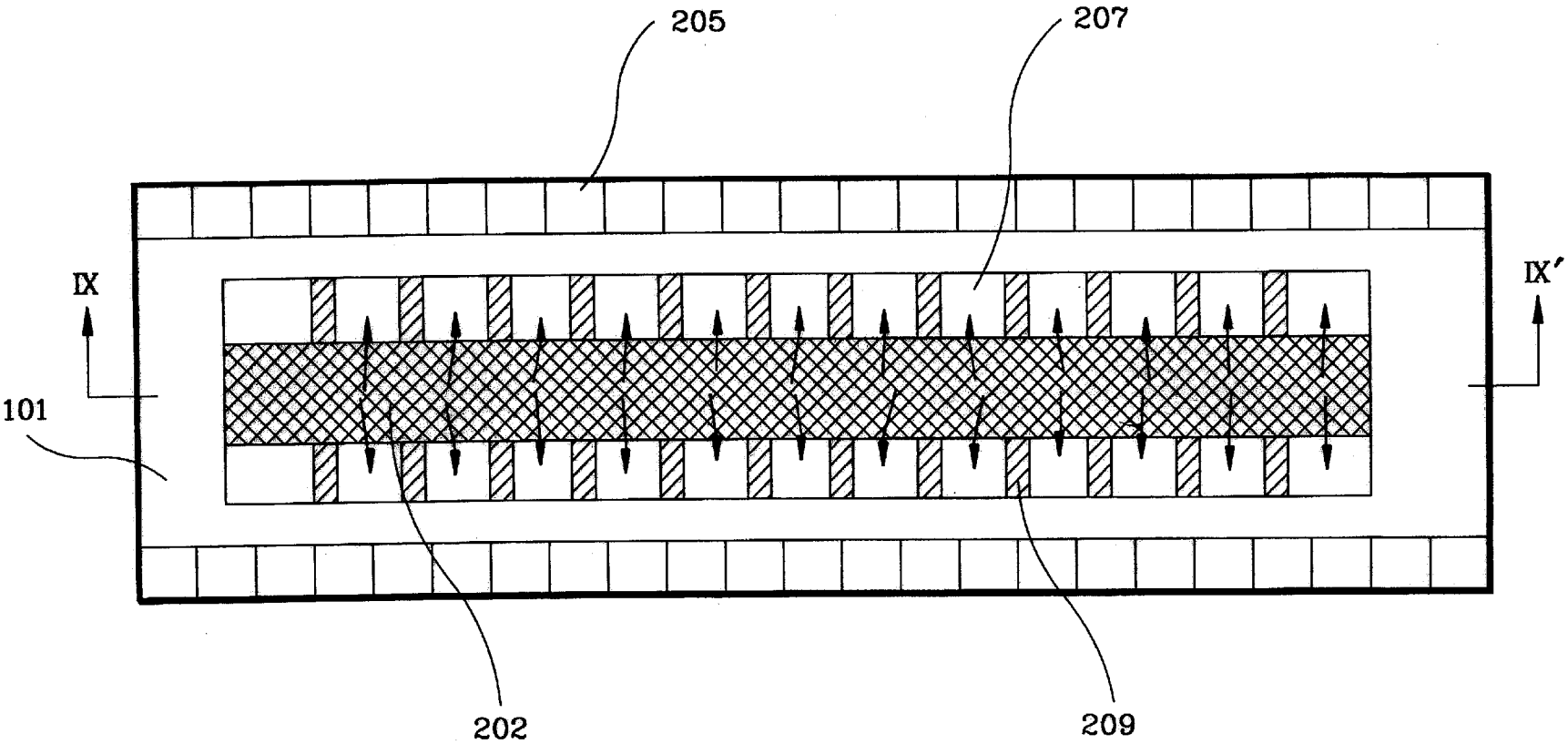
FIG. 8 is a plan view of the ink-jet spraying device of the present invention.
Figure 9:
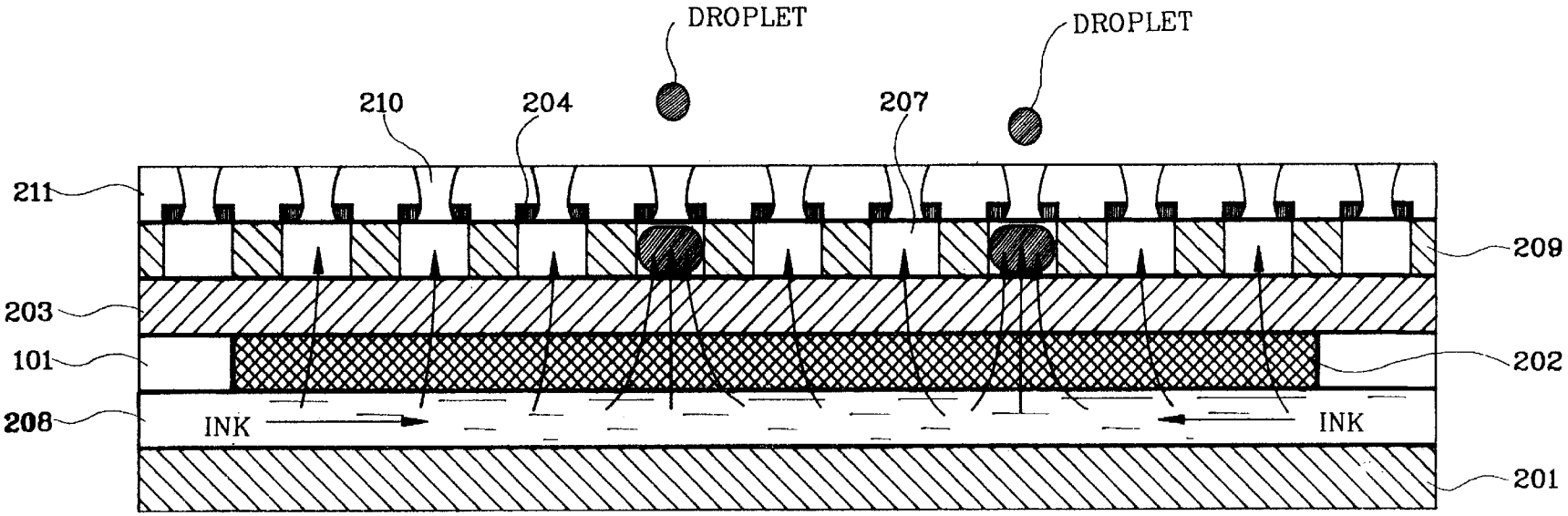
FIG. 9 is a sectional view of the ink-jet spraying device of the present invention cut along line IX–IX' of FIG. 8.

Referring to FIGS. 7–9, an ultrasonic vibration plate 201 receives electric energy and oscillates at a predetermined frequency to separate pigment particles as the coloring matter in an ink, the bulk of which is made up of a fluid acting as a carrier. An ink channel 208, placed above the ultrasonic vibration plate 201, acts as a path for transmitting the ink. Above the ink channel 208, a mesh grid 202 is provided for electrically charging the separated pigment particles, and a common electrode 203 forms an electric field for ejecting the charged pigment particles through an opening 210. It should be appreciated that, in these cutaway side-sectional views, though the common electrode 203 appears to lie atop the mesh grid 202, such that the former completely covers the latter, portions of the upper surface of the mesh grid are flush with that of the common electrode, thus providing a mesh-grid ink path through the common electrode.

There is further provided an ink barrier 209 for forming spaces, i.e., an ink chamber 207, where the pigment particles passing through mesh grid 202 are stored. Above each ink chamber, a plurality of individual electrodes 204 are disposed at the mouth of respective openings 210 formed in a nozzle plate 211. When elements of the above-described structure are properly charged, a moving force is created by a difference in electric field density, which is applied to charged pigment particles in a selected ink chamber, to thereby force (eject) an ink droplet out through the nozzle onto print media.

The individual electrodes may be coated with a dielectric of a predetermined permittivity in order to prevent them from suffering oxide corrosion.

Figure 1:
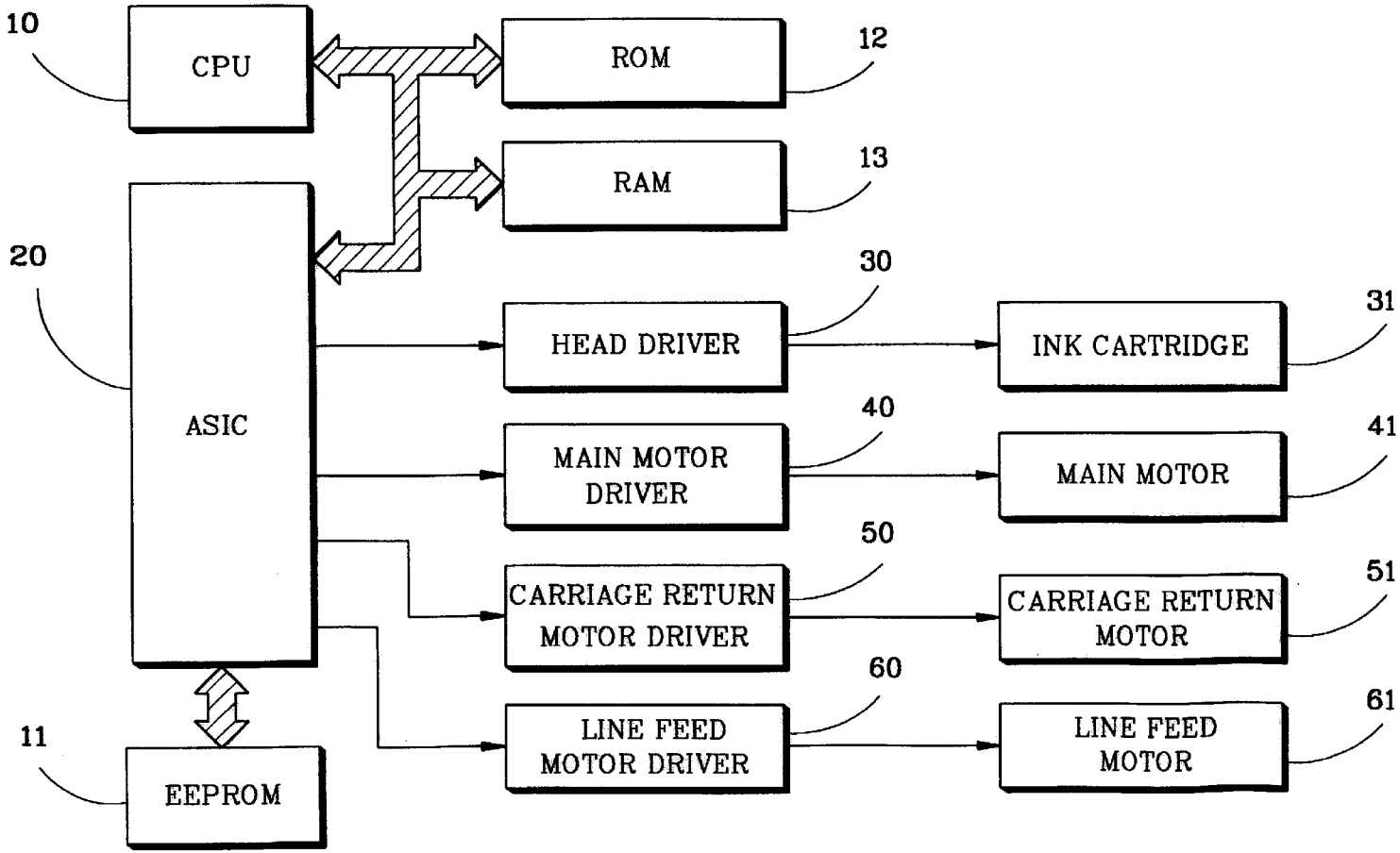
FIG. 1 is a block diagram of a general ink-jet printer.
Figure 3:
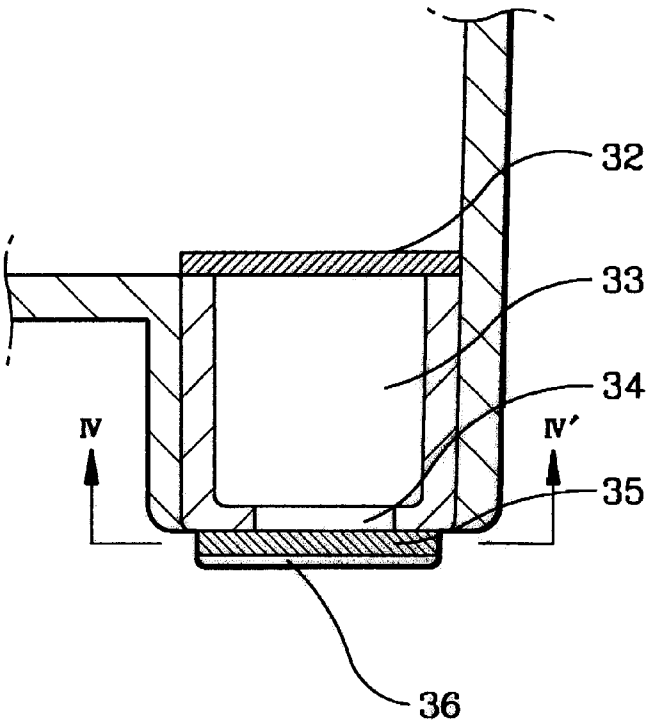
FIG. 3 is an enlarged sectional view of an ink-jet print head.
Figure 2:
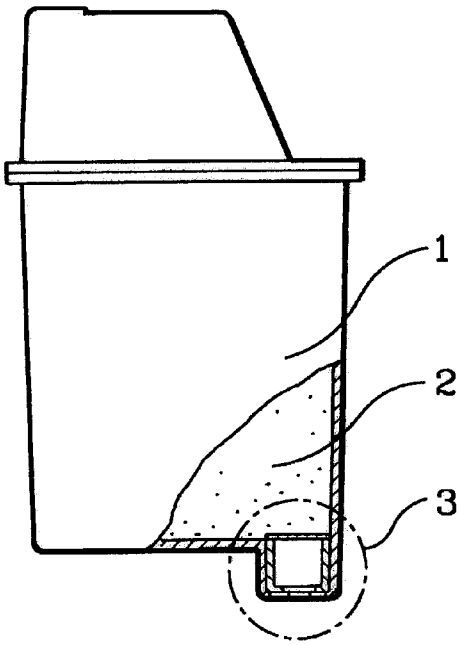
FIG. 2 is a schematic sectional view of an ink cartridge.
Figure 4:
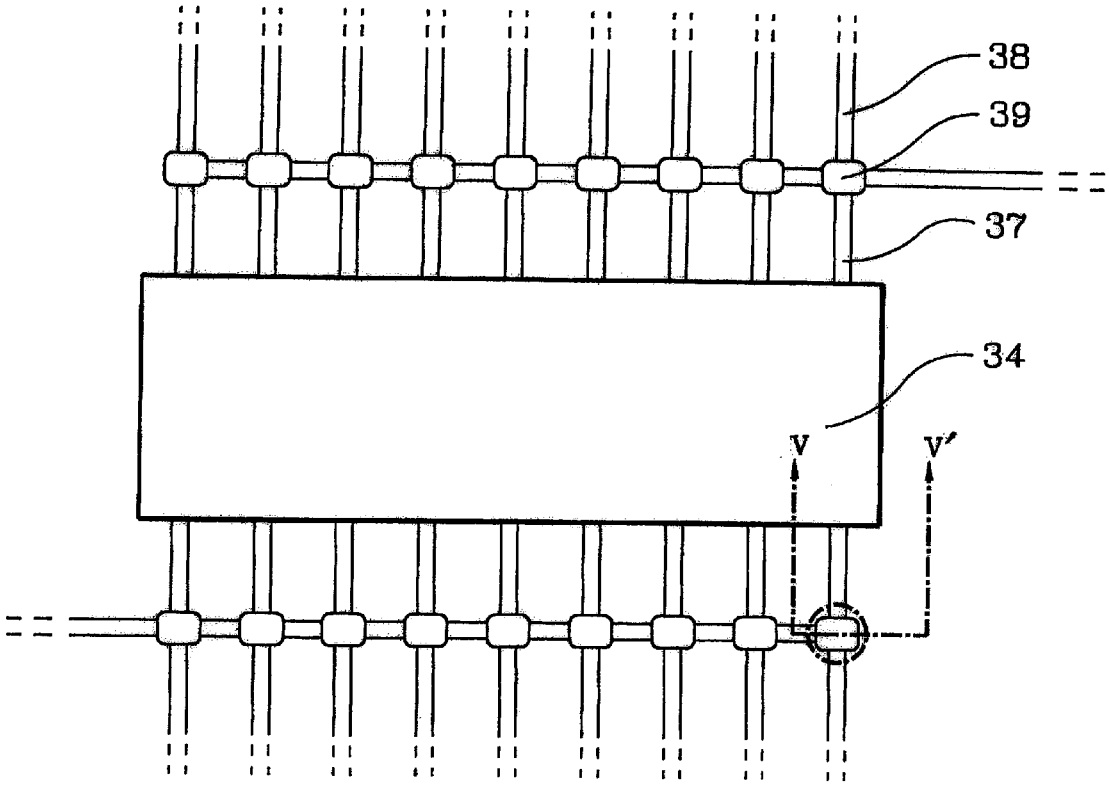
FIG. 4 (PRIOR ART)
FIG. 4 is a plan sectional view of the head cut along line IV–IV' of FIG. 3.
Figure 5:
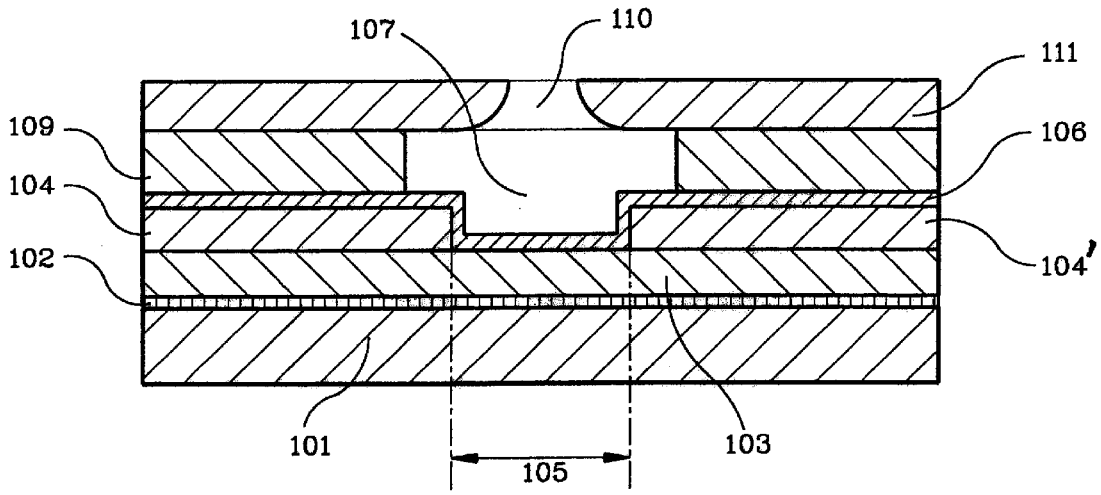
FIG. 5 (PRIOR ART)
FIG. 5 is an enlarged sectional view of the ink-jet spraying device cut along line V–V' of FIG. 4.
Figure 6:
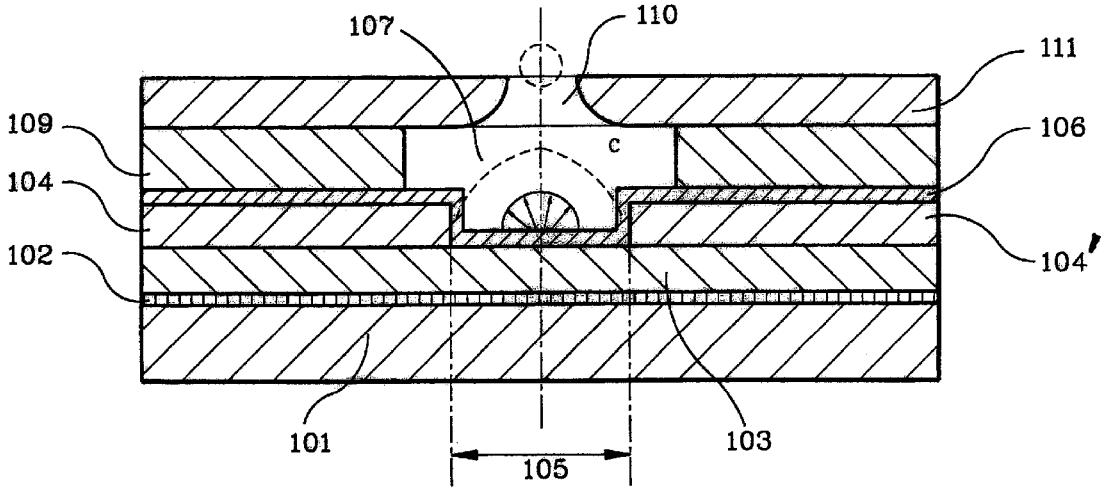
FIG. 6 (PRIOR ART)
FIG. 6 is a diagram, cut along line V–V' of FIG. 4, for explaining the operation of a conventional thermal type inkjet print head.

In the operation of the spraying device of an inkjet printer of the present invention, the ink entering the ink channel 208 from an ink reservoir (see FIG. 3) comes into contact with the ultrasonic vibration plate 201 and is offered to the ink chambers 207 via the mesh grid 202. When the inkjet printer receives a printing command, a frequency voltage Vf is applied to the ultrasonic vibration plate 201 which then starts to vibrate at a high (ultrasonic) frequency. Thus, pigment particles are separated from the liquid of the ink within the ink channel 208. In doing so, the liquid of the ink is vaporized. Here, the minimum frequency required to drive the ultrasonic vibration plate 201 is about 40 kHz.

Figure 10:
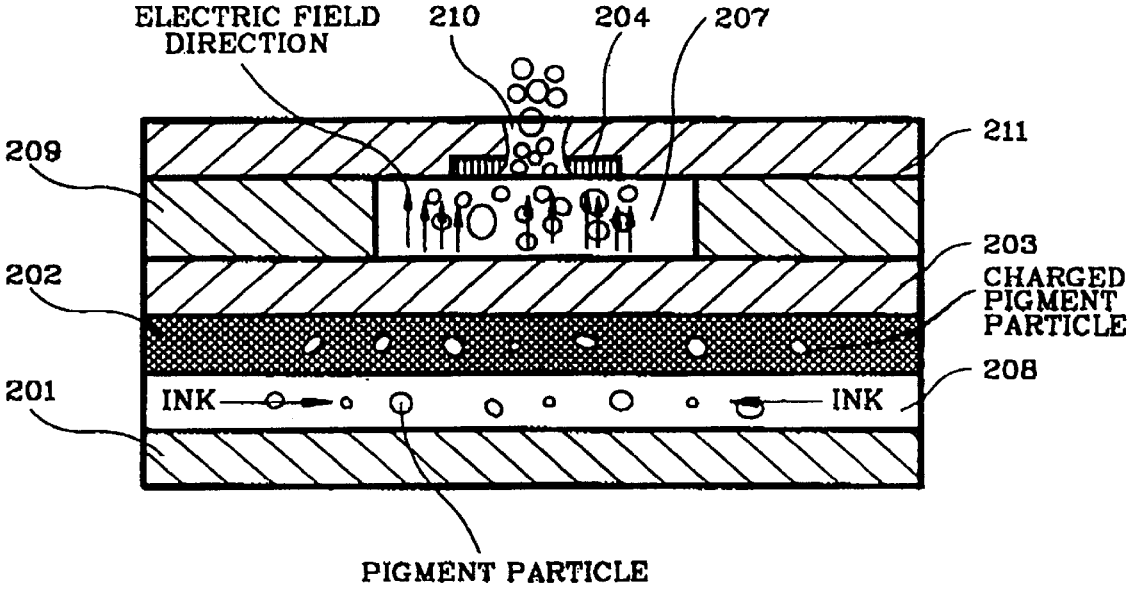
FIGS. 10 and 11 are operational state diagrams showing ink (pigment particle) ejection and retention, respectively, according to the direction/intensity of the electric field created within the ink chamber.
Figure 11:
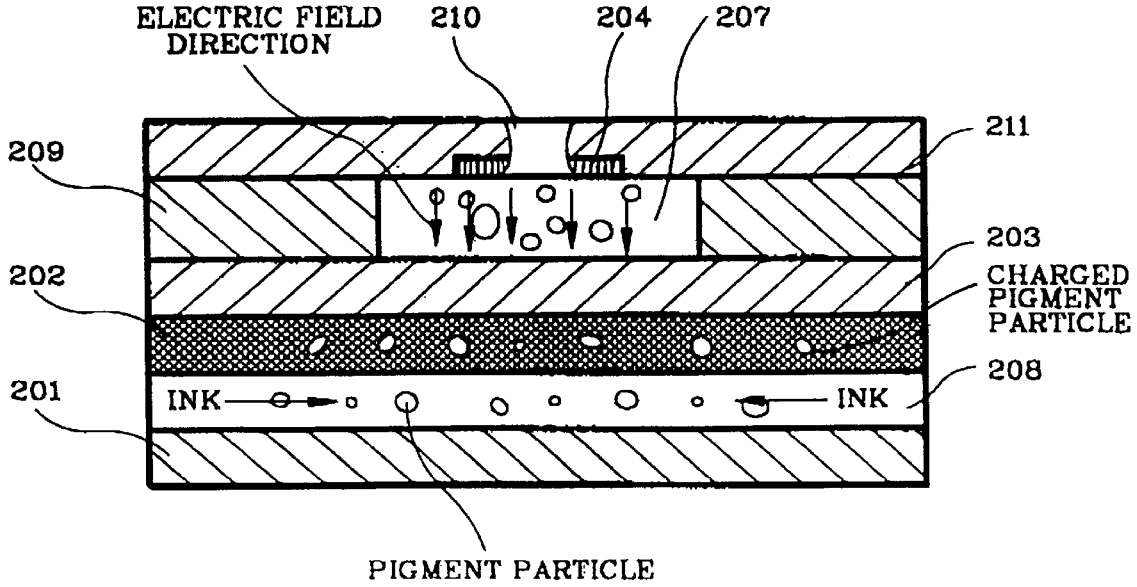

Meanwhile, a first voltage Vg of about +50–500V is fed to the mesh grid 202, which electrically charges the separated pigment particles passing through the mesh grid, and a second voltage Vc, being lower than the first voltage Vg, is applied to the common electrode 203. Since the thus-charged common electrode covers the entire bottom surface of each ink chamber, the charged particles are passed to the multiple ink chambers. Simultaneously, a third voltage Ve is selectively applied to the individual electrodes 204 in accordance with the print command, creating the desired electric field due to the potential difference (or lack thereof) between the common electrode 203 and the individual electrodes 204. Accordingly, the charged pigment particles filling the multiple ink chambers 207 migrate toward the respective openings 210 selected by the application of the third voltage Ve. This selective application of the third voltage Ve is applied to electrode pads 205 such that the potential of an individual electrode 204 located at the desired nozzle positions is interrupted, i.e., lowered with respect to the common electrode 203, as shown in FIG. 10. The ejection of ink is cut off at all other positions, as shown in FIG. 11, by eliminating the potential difference existing between the common electrode 203 and the individual electrodes 204. Here, the potential difference may also be eliminated when Ve is higher than Vc. That is, the flow of a particle of pigment electrically charged is applied in accordance with Coulomb's law. In other words, the particle density and flow within the ink chamber 207 follows the field density and direction.

In the above-described ink-jet spraying device and method using ultrasonic waves, by using the ultrasonic vibration plate, the pigment (coloring matter) of an ink is separated from the liquid (carrier) thereof. The separated pigment particles become electrically charged through the mesh grid. The charged particles migrate toward the openings according to the electric field density formed between the common electrode and the desired individual electrodes, to be sprayed according to a print command.

In the construction of the spraying device featured as above, the ultrasonic vibration plate is used to separate only the pigment particles, and the mesh grid is required to electrically charge the separated particles. For the migration force of the charged pigment particles, the mesh grid, the common electrode and the individual electrodes are all controlled to have a graduated potential difference.

The method according to the present invention includes the steps of: separating particles of coloring matter from the carrier in an ink using an ultrasonic vibration; electrically charging the separated particles via a mesh grid to which a predetermined voltage is applied; forming an electric field in order to exert a migration force to the charged particles in accordance with the direction and intensity of the field, by creating a potential difference between a common electrode and a plurality of individual electrodes in accordance with a print command; and spraying the particles onto print media (e.g., paper) through a plurality of openings in a nozzle plate, according to the direction and density of the formed electric field.

As described above, the construction and operation of the present invention has the following effects.

First, the ink-jet spraying device of the present invention has no heating layer. Therefore, the ejected ink can maintain its peculiar characteristics, without undergoing the stresses of a high-temperature heating phase.

Second, the spraying device performs spouting with the effect of the electric field formed by the electrodes after separating only the pigments using the ultrasonic vibration plate, simplifying the structure and manufacturing process.

Third, a simplification of nozzle plate fabrication reduces product costs, which is especially beneficial in the manufacture of printers using array-type nozzle plates.

Fourth, by separating the pigment from the ink, the time required for drying after printing is greatly reduced, since only a slight amount of liquid remains in the ejected ink.

It will be apparent to those skilled in the art that various modifications can be made in the ink-jet spraying device and method using ultrasonic waves of the present invention, without departing from the spirit of the invention. Thus, it is intended that the present invention cover such modifications as well as variations thereof, within the scope of the appended claims and their equivalents.

What is claimed is:

1. An ink-jet spraying device, comprising:

an ink chamber for holding pigment particles of ink, said ink chamber disposed adjacent to an opening in a nozzle plate, said nozzle plate being disposed above said ink chamber;

an ultrasonic vibration plate which vibrates in order to separate said pigment particles suspended in liquid ink;

a channel containing said pigment particles suspended in said liquid ink, said channel located adjacent to and directly above said ultrasonic vibration plate;

a plurality of individual electrodes disposed above said ink chamber and embedded in said nozzle plate;

a common electrode disposed below and adjacent to said ink chamber; and a mesh grid for electrically charging the separated pigment particles, said mesh arid having a voltage applied thereto, said mesh grid being disposed between said common electrode and said channel containing said pigment particles suspended in said liquid ink.

2. The device as claimed in claim 1, wherein a voltage applied to said mesh grid is greater than or equal to a voltage applied to said common electrode and said plurality of individual electrodes.

3. The device as claimed in claim 1, wherein said plurality of individual electrodes are coated with a dielectric of a predetermined permittivity.

4. The device as claimed in claim 1, wherein the vibrating frequency of said ultrasonic vibration plate is greater than 40 kHz.

5. The device as claimed in claim 1, wherein the voltage applied to said mesh grid is between 50V and 500V.

6. The device of claim 1, wherein a voltage is applied to said common electrode and an opposite voltage is applied to said plurality of individual electrodes resulting in an electric field in said ink chamber to accelerate said charged pigment particles through said opening in said nozzle plate.

7. The device as claimed in claim 6, wherein the separated pigment particles acquire an electric polarity while passing through said mesh grid.

8. An ink-jet spraying method, comprising the steps of:

separating particles of coloring matter from a liquid based ink carrier, using ultrasonic waves;

electrically charging the separated particles via a mesh grid to which a voltage is applied said mesh grid being disposed between an ink channel and an ink barrier;

forming an electric field produced in said ink chamber in order to exert a migration force to the electrically charged particles in accordance with the direction and intensity of the field; and ejecting the particles through a plurality of openings in a nozzle plate, according to the direction and density of the formed electric field.

9. An ink-jet spraying device, comprising:

an ink channel for providing liquid ink from an ink reservoir;

an ultrasonic vibration plate which vibrates in order to separate pigment particles from a carrier of the liquid ink, said ultrasonic vibration plate being located adjacent and beneath said ink channel;

a nozzle plate having a plurality of openings;

an ink barrier having a plurality of ink chambers for holding said pigment particles;

a common electrode installed under said plurality of ink chambers between said plurality of ink chambers and said ink barrier;

a plurality of individual electrodes disposed adjacent to said plurality of openings; and a mesh grid electrically charging the separated pigment particles, said mesh grid having a voltage applied thereto, said mesh grid being disposed between said ink channel and said ink barrier.

10. The device as claimed in claim 9, wherein the charged pigment particles acquire an electric polarity while passing through said mesh grid.

11. The device as claimed in claim 9, wherein a voltage is applied to said mesh grid is greater than or equal to a voltage applied to said common electrode and said plurality of individual electrodes.

12. The device as claimed in claim 9, wherein said individual electrodes are integrally formed with a nozzle plate perforated by said plurality of openings.

13. The device as claimed in claim 9, wherein said plurality of individual electrodes are coated with a dielectric of a predetermined permittivity.

14. The device as claimed in claim 9, wherein a vibrating frequency of said ultrasonic vibration plate is greater than 40 kHz.

15. The device as claimed in claim 9, wherein said voltage applied to said mesh grid is between 50V and 500V.

16. The device of claim 9, wherein a voltage is applied to said common electrode and an opposite voltage is applied to said plurality of individual electrodes resulting in an electric field in said ink chamber to accelerate said charged pigment particles through said plurality of openings in said nozzle plate.

* * * * *